US005865985A

United States Patent [19]

Desai et al.

[11] Patent Number: 5,865,985

[45] **Date of Patent: *Feb. 2, 1999**

[54] PROCESS FOR THE PRODUCTION OF DIESEL

[75] Inventors: Pankaj Himatlal Desai, Houston, Tex.; Johannes Wilhelmus Sonnemans, Soest, Netherlands; Terry Allan Reid, Seabrook, Tex.

[73] Assignee: Akzo Nobel NV, Arnhem, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 818,115

[22] Filed: Feb. 14, 1997

[51] Int. Cl.[6] ..... C10G 45/00

[52] U.S. Cl. ..... 208/57; 208/144; 208/145; 585/269; 585/270; 585/274; 585/275; 585/276; 585/315

[58] Field of Search ..... 208/57, 143, 144, 208/145; 585/269, 270, 273, 274, 275, 276, 277

[56] References Cited

U.S. PATENT DOCUMENTS

| | | | |
|---|---|---|---|
| 3,642,612 | 2/1972 | Girotti et al. | 208/89 |
| 4,363,719 | 12/1982 | Bousquet et al | 208/111 |
| 5,068,025 | 11/1991 | Bhan | 208/57 |
| 5,183,556 | 2/1993 | Reilly et al. | 208/57 |
| 5,558,766 | 9/1996 | Prada et al. | 208/59 |

FOREIGN PATENT DOCUMENTS

| | | | |
|---|---|---|---|
| 0 519 573 | 12/1992 | European Pat. Off. | B01J 29/12 |
| 940290 | 10/1963 | United Kingdom . | |
| 2 073 770 | 10/1981 | United Kingdom | C10G 5/02 |
| 205 925 | 1/1984 | United Kingdom | C10G 65/12 |

OTHER PUBLICATIONS

*Gasoline and Other Motor Fuels*, vol. 11, pp. 683–684.

*Primary Examiner*—Bekir L. Yildirim
*Attorney, Agent, or Firm*—Oliff & Berridge, PLC

[57] ABSTRACT

A process for the production of a diesel fuel includes contacting a feedstock comprising cracked stocks in the presence of hydrogen under conditions of elevated temperature and pressure with a first catalyst comprising a Group VI hydrogenation metal component and a Group VIII hydrogenation metal component on a substantially non-acidic carrier, and then contacting at least a portion of the effluent from the first catalyst with a second catalyst comprising a Group VI hydrogenation metal component and a Group VIII hydrogenation metal component on an acidic carrier. This process can produce diesel fuels having an improved cetane index and API gravity. The effluent from the second catalyst bed may be contacted with a third catalyst bed which contains a catalyst comprising a Group VI hydrogenation metal component and a Group VIII hydrogenation metal component on a substantially non-acidic carrier.

20 Claims, No Drawings

PROCESS FOR THE PRODUCTION OF DIESEL

FIELD OF THE INVENTION

The present invention relates to a process for the production of diesel fuel with an improved cetane index and API gravity.

BACKGROUND OF THE INVENTION

As a fuel for internal-combustion engines, diesel fuel ranks second only to gasoline. Further, the importance of diesel as fuel is expected to grow, due to reasons of fuel economy.

A good diesel fuel should meet certain specified requirements. One of the most well known is the cetane index. The cetane index of a diesel fuel is a measure for the ignition quality of a diesel. In general, high cetane fuels eliminate engine roughness or diesel knock, permit an engine to be started at lower air temperatures, provide faster engine warm-up without misfiring or producing white smoke, and reduce the formation of coke deposits. Cetane, which has a high ignition quality represents 100 on the cetane index scale. The cetane index of a fuel depends mainly on its hydrocarbon composition. In general, paraffins have a high cetane index, followed by olefins and cycloparaffins, while aromatics have the lowest cetane index. Another parameter which is of importance for a diesel fuel is its API gravity, which is a measure for the density of fuel. Diesel fuel is sold by volume. The greater the volume swell (density decrease), the greater the increase in product value.

We have now developed a process for the production of a diesel fuel with an improved cetane index and API gravity. In addition, this desired effect is obtained without a substantial increase in hydroconversion activity.

SUMMARY OF THE INVENTION

The present invention generally relates to a process for the production of a diesel fuel comprising contacting a feedstock with 20% or more of two-ring aromatics as measured by HPLC in the presence of hydrogen under conditions of elevated temperature and pressure with a first catalyst comprising a Group VI hydrogenation metal component and a Group VIII hydrogenation metal component on a substantially non-acidic carrier, after which at least part of the effluent from the first catalyst is led to a second catalyst comprising a Group VI hydrogenation metal component and a Group VIII hydrogenation metal component on an acidic carrier.

DETAILED DESCRIPTION OF THE INVENTION

The present invention is directed to a process for the production of a diesel fuel comprising contacting a feedstock with 20% or more of two-ring aromatics as measured by HPLC in the presence of hydrogen under conditions of elevated temperature and pressure with a first catalyst comprising a Group VI hydrogenation metal component and a Group VIII hydrogenation metal component on a substantially non-acidic carrier, after which at least part of the effluent from the first catalyst is led to a second catalyst comprising a Group VI hydrogenation metal component and a Group VIII hydrogenation metal component on an acidic carrier. The feedstock generally comprises at least 25% of cracked stocks such as LCOs and coker middle distillates.

The catalyst to be used in the first step of the process according to the invention comprises a Group VI hydrogenation metal component and a Group VIII hydrogenation metal component on a substantially non-acidic carrier. By "substantially non-acidic" it is meant that the catalyst has only a limited, if any, cracking activity. Preferably, the carrier comprises silica or alumina. More preferably, the carrier consists substantially of silica or alumina. Still more preferably, the carrier consist substantially of alumina. With the wording "consists substantially of alumina", it is meant that the carrier consists basically of alumina, but may contain minor amounts of other components as long as they do not influence the catalytic properties of the catalyst.

The Group VI metal is preferably molybdenum, tungsten, or a mixture thereof. Molybdenum is generally preferred. The Group VIII metal is preferably nickel, cobalt, or a mixture thereof, with nickel being generally preferred. The Group VI hydrogenation metal component is generally present in an amount of 5–40 wt. %, preferably 10–30 wt. %, more preferably 17–27 wt. %, calculated as trioxide. The Group VIII metal component is generally present in an amount of 0.5–10 wt. %, preferably 2–7 wt. %. In addition to the Group VI hydrogenation metal component and the Group VIII hydrogenation metal component, the catalyst may additionally contain phosphorus. If the catalyst contains phosphorus, this compound is generally present in an amount of 1–10 wt. %, preferably 4–8 wt. %.

The catalyst to be used in the second bed of the process according to the invention comprises a Group VI hydrogenation metal component and a Group VIII hydrogenation metal component on an acidic carrier. Preferably, the carrier comprises silica and alumina. More preferably, the carrier substantially consists of alumina and silica in such an amount that the final catalyst contains 20–70 wt. % of silica, preferably 25–40 wt. %. By the wording "substantially consists of alumina and silica" it is meant that the carrier consists basically of alumina and silica, but may contain minor amounts of other components as long as they do not influence the catalytic properties of the catalyst. The Group VI metal is preferably molybdenum, tungsten, or a mixture thereof, with molybdenum generally being preferred. The Group VIII metal is preferably nickel, cobalt, or a mixture thereof, with nickel generally being preferred. The Group VI hydrogenation metal component is generally present in an amount of 5–40 wt. %, preferably 8–30 wt. %, more preferably 10–20 wt. %, calculated as trioxide. The Group VIII metal component is generally present in an amount of 0.5–10 wt. %, preferably 2–7 wt. %. In addition to the Group VI hydrogenation metal component and the Group VIII hydrogenation metal, the catalyst may additionally contain phosphorus. If the catalyst contains phosphorus, this compound is generally present in an amount of 1–10 wt. %, preferably 4–8 wt. %.

The catalysts may be prepared by processes known in the art for this purpose. The catalysts are generally employed in the form of spheres or extrudates. Examples of suitable types of extrudates have been disclosed in the literature. Highly suitable for use are cylindrical particles (which may be hollow or not) as well as symmetrical and asymmetrical polylobed particles (3 or 4 lobes).

The catalysts are generally employed in the process according to the invention in the sulphided form. To this end use may be made of ex-situ as well as in-situ (pre) sulphidation techniques. Such methods are known to the skilled person. The ratio between the first bed catalyst and the second bed catalyst is generally between 10:90 and 90:10, preferably between 25:75 and 75:25. The catalysts may be present in the same reactor or in different reactors.

The process according to the invention is carried out at elevated temperature and pressure. The first step is generally carried out at a temperature of 200°–450° C., preferably 300°–400° C., more preferably 350°–400° C. The second step is also generally carried out at a temperature of 200°–450° C., preferably 300°–400° C., more preferably 350°–400° C. The temperature in the first and the second step may be the same, but this is not necessary. The process according to the invention is generally carried out at a pressure of 20–200 bar gauge, preferably 40–140 bar gauge. It is preferred for reasons of processing technology that the pressure in the first bed and in the second bed are the same. However, this is not necessary. The liquid hourly space velocity for both beds is preferably between 0.1 and 10 vol./vol.h, more preferably between 0.5 and 5 vol./vol.h. The $H_2$/oil ratios are generally in the range of 50–2000 NI/I.

The process according to the invention may be carried out as follows. A feedstock is contacted at elevated temperature and pressure in the presence of hydrogen with the first bed catalyst. The first catalyst effects conversion of at least some of the sulphur and nitrogen present in the feed in the form of organic compounds into ammonia and hydrogen sulphide. The product resulting from the first catalyst bed consists in effect of two phases, a liquid phase and a gaseous phase. The ammonia and hydrogen sulphide formed in the first step are for the most part present in the gaseous phase. It is possible to remove these compounds from the system by effecting an intermediate phase separation between the first catalyst bed and the second catalyst bed. This intermediate phase separation is not essential to the process according to the invention, but may be advantageous, in particular if the feedstock contains substantial amounts of sulphur and/or nitrogen. If so desired, it is possible to fractionate the effluent from the first catalyst bed so as to select a fraction with an appropriate boiling range to be fed to the second bed. However, this measure is generally not necessary. If a fractionation of the resulting product is necessary, it can generally better be carried out after the second step.

At least part of the effluent from the first bed is thus led to the second catalyst bed, which is operated at elevated temperature and pressure in the presence of hydrogen. The second catalyst bed effects the conversion of at least some of the aromatics in the feedstock to parafins, which leads to an increased cetane index of the product. In addition, the process according to the invention also leads to a product with an increased cetane index being obtained as compared to the use of the first bed catalyst alone. The increase in cetane index and API gravity as compared to the use of the first bed catalyst alone is accompanied by only a minor, if any, increase in hydrocracking activity, which, in view of the fact that the second bed catalyst comprises an acidic carrier, is rather surprising.

If so desired, one may recycle part of the effluent from the first step back into the first step, or one may recycle part of the effluent from the second step back to either the first step or the second step.

Sometimes it may be desirable to subject the product of the second step to a further processing step. For example, one may lead the effluent of the second step to a third catalyst bed which contains a catalyst comprising a Group VI hydrogenation metal component and a Group VIII hydrogenation metal component on a substantially non-acidic carrier. The catalyst to be used in this step may thus meet the same requirements as stipulated above for the first bed catalyst. In effect, it may be the same catalyst, but this is not required. The contacting of the effluent of the second step with a catalyst bed of this type will lead to a product with higher API gravity and cetane index, and lower sulphur and nitrogen.

Any additional step to the process according to the invention may be carried out under the same conditions as given above for the two earlier steps of the process according to the invention. Selection of the optimum process conditions is within the scope of the skilled person. Intermediate phase separation, fractionation, and/or liquid recycle may be applied if appropriate.

If a third catalyst bed is applied, the volume ratio between the first bed catalyst, the second bed catalyst and the third bed catalyst may in general vary between wide ranges, in which each of the catalysts can make up 5–90% of the total amount of catalyst. Preferably, each catalyst makes up 10–70 wt. % of the total amount of catalyst.

EXAMPLE 1

Two sets of catalysts were tested side by side in an upflow tubular reactor. Two reaction tubes were filled with 75 ml of catalyst homogeneously intermixed with 80 ml of carborundum particles. The first reactor contained a catalyst comprising 24 wt. % of molybdenum, calculated as trioxide, 4 wt. % of nickel, calculated as oxide, and 7 wt. % of phosphorus, calculated as $P_2O_5$, on an alumina carrier. This catalyst will further be indicated as catalyst A. The second reactor was loaded with 75 ml of a catalyst system comprising catalyst A and a catalyst SA in the sequence A/SA/A in a volume ratio of 30:30:40. Catalyst SA contains 11 wt. % of molybdenum, calculated as trioxide, and 4 wt. % of nickel, calculated as oxide, on a carrier containing 35 wt. % of silica, calculated on the catalyst, and the balance alumina. The catalysts were presulphided using an SRLGO in which dimethyl sulphide had been dissolved to an S content of 2.5 wt. %. A feed with the following properties was used in the Example.

| | Diesel |
|---|---|
| Nitrogen (ASTM D-4629) (ppm wt) | 639 |
| Sulphur (ASTM D-4294) (wt. %) | 1.812 |
| Density 15° C. (g/ml) | 0.8965 |
| API gravity | 26.3 |
| HPLC aromatics (wt. %) | |
| Mono | 22.0 |
| Di | 25.4 |
| Tri+ | 5.2 |
| Total | 52.6 |
| Dist. (°C.) | D86 |
| IBP | 179 |
| 5 vol. % | 219 |
| 10 vol. % | 230 |
| 30 vol. % | 254 |
| 50 vol. % | 276 |
| 70 vol. % | 301 |
| 90 vol. % | 336 |
| 95 vol. % | 356 |
| FBP | 362 |

The catalyst systems were tested under the following conditions.

| | |
|---|---|
| Temperature (°C.) | 360 |
| Pressure (bar gauge) | 65 |
| $H_2$/oil (NI/I) | 1185 |
| LHSV | 0.8 |
| Days | 5 |

The properties of the total liquid product and the diesel fraction (the 260° C.+ cut) obtained with each catalyst system are given in the following Table.

| | Whole liquid product | | Diesel fraction (260° C. + cut) | |
|---|---|---|---|---|
| | A | A/SA/A | A | A/SA/A |
| Yield | | | 55.27 | 54.3 |
| Nitrogen (ppmwt) | <1.0 | <10 | <1 | <5 |
| Sulphur (ppmwt) | <50 | <50 | 15 | 5 |
| Cetane index | 40.3 | 42.6 | 43.7 | 45.1 |
| API gravity | 30.83 | 32.35 | 28.73 | 29.85 |
| Density 15° C. (g/ml) | 0.8717 | 0.8636 | 0.8831 | 0.8770 |
| HPLC aromatics (wt. %) | | | | |
| Mono | 36.5 | 35.3 | 29.3 | 29.4 |
| Di | 4.4 | 3.7 | 5.1 | 4.8 |
| Tri+ | 0.3 | 0.5 | 1.2 | 1 |
| Total | 41.2 | 39.5 | 35.6 | 35.2 |
| Dist. (°C.) | D86 | D86 | D1160 | D1160 |
| IBP | 173 | 153 | 260 | 260 |
| 10 vol. % | 223 | 213 | 279 | 280 |
| 30 vol. % | 246 | 242 | 290 | 290 |
| 50 vol. % | 266 | 265 | 304 | 302 |
| 70 vol. % | 289 | 292 | 321 | 321 |
| 90 vol. % | 326 | 332 | 355 | 355 |
| FBP | 354 | 355 | 410 | 388 |

From the above results it appears that the use of the A/SA/A catalyst system of the process of the invention results in a substantial increase in both cetane index and API gravity as compared to the use of catalyst A alone. Further, contrary to what one might expect, the use of the A/SA/A catalyst system results in only a marginally increased hydrocracking activity.

We claim:

1. A process for the production of a diesel fuel, comprising:

contacting a feedstock comprising at least 25% of cracked stocks in the presence of hydrogen under conditions of elevated temperature and pressure with a first catalyst comprising a Group VI hydrogenation metal component and a Group VIII hydrogenation metal component on a substantially non-acidic carrier; and subsequently contacting at least part of an effluent from the first catalyst with a second catalyst comprising a Group VI hydrogenation metal component and a Group VIII hydrogenation metal component on an acidic carrier.

2. The process according to claim 1, in which the first catalyst comprises molybdenum, tungsten, or a mixture thereof as the Group VI hydrogenation metal component, and cobalt, nickel, or a mixture thereof as the Group VIII hydrogenation metal component.

3. The process according to claim 1, in which the carrier of the first catalyst consists essentially of alumina.

4. The process according to claim 1, in which the second catalyst comprises molybdenum, tungsten, or a mixture thereof as the Group VI hydrogenation metal component, and cobalt, nickel, or a mixture thereof as the Group VIII hydrogenation metal component.

5. The process according to claim 1, in which the acidic carrier of the second catalyst consists substantially of alumina and silica in an amount such that the final catalyst contains 20–70 wt. % of silica.

6. The process according to claim 1, in which the ratio between the first catalyst and the second catalyst is between 10:90 and 90:10.

7. The process according to claim 6, in which the ratio between the first catalyst and the second catalyst is between 25:75 and 75:25.

8. The process according to claim 1, wherein the step of contacting with the first catalyst is carried out at a temperature of 200°–450° C. and a pressure of 20–200 bar gauge.

9. The process according to claim 1, wherein the step of contacting with the second catalyst is carried out at a temperature of 200°–450° C. and a pressure of 20–200 bar gauge.

10. The process according to claim 1, further comprising contacting an effluent from the second catalyst with a third catalyst comprising a Group VI hydrogenation metal component and a Group VIII hydrogenation metal component on a substantially non-acidic carrier.

11. The process according to claim 1, wherein the acidic carrier of the second catalyst consists substantially of alumina and silica in an amount such that the final catalyst contains 25–40 wt. % of silica.

12. A process for the production of a diesel fuel, comprising:

contacting a feedstock with 20% or more of two-ring aromatics as measured in the presence of hydrogen under conditions of elevated temperature and pressure with a first catalyst comprising a Group VI hydrogenation metal component and a Group VIII hydrogenation metal component on a substantially non-acidic carrier consisting essentially of alumina or silica; and subsequently contacting at least a portion of an effluent from the first catalyst with a second catalyst comprising a Group VI hydrogenation metal component and a Group VIII hydrogenation metal component on an acidic carrier consisting substantially of alumina and silica.

13. The process according to claim 12, wherein the first catalyst comprises molybdenum, tungsten, or a mixture thereof as the Group VI hydrogenation metal component, and cobalt, nickel, or a mixture thereof as the Group VIII hydrogenation metal component.

14. The process according to claim 12, wherein the second catalyst comprises molybdenum, tungsten, or a mixture thereof as the Group VI hydrogenation metal component, and cobalt, nickel, or a mixture thereof as the Group VIII hydrogenation metal component.

15. The process according to claim 12, wherein the acidic carrier of the second catalyst consists substantially of alumina and silica in an amount such that the final catalyst contains 20–70 wt. % of silica.

16. The process according to claim 12, wherein the ratio between the first catalyst and the second catalyst is between 10:90 and 90:10.

17. The process according to claim 16, wherein the ratio between the first catalyst and the second catalyst is between 25:75 and 75:25.

18. The process according to claim 12, wherein the step of contacting with the first catalyst is performed at a temperature of 200°–450° C. and a pressure of 20–200 bar gauge, and the step of contacting with the second catalyst is performed at a temperature of 200°–450° C. and a pressure of 20–200 bar gauge.

19. The process according to claim 12, further comprising contacting an effluent from the second catalyst with a third catalyst comprising a Group VI hydrogenation metal component and a Group VIII hydrogenation metal component on a substantially non-acidic carrier.

20. The process according to claim 12, wherein the acidic carrier of the second catalyst consists substantially of alumina and silica in an amount such that the final catalyst contains 25–40 wt. % of silica.

* * * * *